United States Patent [19]

Schortmann

[11] Patent Number: 4,499,139

[45] Date of Patent: Feb. 12, 1985

[54] MICROSIZED FABRIC

[75] Inventor: Walter E. Schortmann, West Hartford, Conn.

[73] Assignee: The Kendall Company, Boston, Mass.

[21] Appl. No.: 585,696

[22] Filed: Mar. 2, 1984

[51] Int. Cl.[3] ..... B32B 7/00

[52] U.S. Cl. ..... 428/245; 428/260; 428/290; 428/315.5; 428/325; 428/421; 428/913

[58] Field of Search ..... 428/245, 265, 269, 287, 428/290, 325, 337, 315.5, 315.7, 304.4, 913, 421

[56] References Cited

U.S. PATENT DOCUMENTS 4,188,446 2/1980 Friedman ..... 428/288

4,196,245 4/1980 Kitson et al. ..... 428/198

4,308,303 12/1981 Mastroianni et al. ..... 428/287

*Primary Examiner*—James J. Bell

*Attorney, Agent, or Firm*—Edward J. Scahill, Jr.

[57] ABSTRACT

An aerated latex microsized single ply hydroentangled fabric wherein a latex mixture is aerated by an Oakes foamer, and then applied to a fabric by a knife-over-roll applicator whereby the latex is worked below the surface of said fabric. The thusly sized fabric is then dried by passing it through an oven. The present invention enables the acquisition of sufficient hydrophobicity in the fabric so as to be a bacterial barrier while preserving therein comfort, drapeability, air permeability, flexibility, and hand. In addition to preserving the above properties, microsizing does not detract from sterilizability of the fabric.

14 Claims, 4 Drawing Figures

MICROSIZED FABRIC

BACKGROUND OF THE INVENTION

This invention relates to a single ply, hydroentangled, nonwoven fibrous fabric that is comfortable, drapeable, flexible, non-linting, anti-static, non-flammable, strong, air permeable, quiet and is a bacterial barrier. More specifically, it relates to a microsized fabric wherein a latex has been worked below the surface of the fabric in order to impart the above-mentioned advantages.

A fabric as mentioned would have many applications, for example, hospital operating room surgical gowns, hospital draperies, upholstery and rain wear.

The present invention has the aforementioned properties and is particularly well suited for use as a surgical gown.

There is an ever present need in hospital operating rooms for a fabric that is comfortable, drapeable, flexible, non-linting, anti-static, non-flammable, strong, air permeable, quiet and is a bacterial barrier, for use as a surgical gown.

Prior art has tried to meet that need but has continuously fallen short of its goal.

U.S. Pat. No. 4,196,245, discloses a fabric that is composed of multiple plies, more specifically (3) three plies or more of different fibers. It is suggested in said patent that the prior art has succeeded in combining all the necessary physical properties, as mentioned in an earlier paragraph, that are needed in a fabric to make it a superior hospital surgical gown.

There are two important factors not considered by this prior art. The first factor is when fabrics are comprised of several plies of fiber, a certain degree of stiffness is inherent in the fabric. The second factor is that delamination of the fabric may take place when several plies of fiber are used.

If there is stiffness present in a fabric, there is a disadvantage built into the fabric, because with stiffness, the softness, drapeability, flexibility and good hand characteristics of cloth cannot be met with total satisfaction. Additionally, fabrics made in multiple plies have a tendency to delaminate for many reasons, but particularly due to poor adhesion between plies in the fabrication process. In addition, multiple ply fabrics are obviously more expensive to produce than the present invention, a single ply fabric.

U.S. Pat. No. 4,308,303, discloses a fabric, wherein a microporous plastic film is used as the base material. This patent suggests that a fabric has been found that has all the required prerequisites to meet the strict standards of a hospital surgical gown. However, there are disadvantages prevalent in this fabric which are based on its claim to filter bacteria. Patentee explains therein that water which has been inoculated with bacteria can be forced through the microporous plastic film used in the fabric. Water is forced through the microporous plastic film under moderate pressure, with sterile water being recovered on the other side of the film. The disadvantages to this prior art are: if the prior art fabric allows water and body liquids to penetrate the plastic film, these liquids will wet the skin of the wearer, causing the wearer to be uncomfortable; and if liquid is allowed to pass through the fabric, the inner side of the fabric will eventually become wet. When both the inside and outside of a fabric becomes wet, as may happen in a hospital setting, wicking of the liquid, with bacteria present, may take place from the exterior to the interior of the fabric. Once this condition exists, bacteria may well penetrate the fabric; come in contact with the wearer; and, thus subject the wearer to infection and/or contamination.

U.S. Pat. No. 4,188,446, discloses a nonwoven sheet material for use in hospitals which is comprised of cellulosic paper-making fibers and a binder which is applied therein in an amount sufficient to increase the strength of said sheet material. The increase in strength of this sheet material, as tested in a Mullen burst strength test, is significant. However, the test conducted was a dry test, and therefore the sheet material was not subjected to liquid. It is well known, however, that if a paper material is wetted by a liquid, the strength of such a material may deteriorate. This deterioration is due to the composition and short length of paper fibers, which, when wet have no strength because the bond between fibers is destroyed. Therefore, paper products, need to have binders for strength; but when binders are added for strength the paper product becomes non drapeable. The paper product is non drapeable because when the binder dries, it makes the product stiff. To make paper products drapeable, less binder is used, thus making a weak bond between paper fibers. If this is the case, the paper product when wetted will be sufficiently weakened to be inadequate for a hospital surgical gown.

The present invention has succeeded, where the prior art has not, by producing a strong single ply fabric with all of the physical properties mentioned in earlier paragraphs. The present invention is thus superior to prior art materials because it not only prevents liquid penetration, while permitting high air permeability, but acts as a bacterial barrier. In addition, the present invention due to a thermoplastic component, namely an acrylic latex in the froth, is heat sealable—a distinct advantage over prior art.

SUMMARY OF THE INVENTION

The invention relates to a single ply, hydroentangled nonwoven fibrous web wherein an aerated latex froth is applied to microsize the fabric. Microsizing is defined herein as the application of a latex froth to a fabric to create microsize pores, which are necessary to establish a bacterial barrier in a fabric while preserving air permeability. The latex clay froth sizing lies beneath the face surface of the fabric leaving the fibers on the face surface exposed but substantially bonded by the froth while the fibers on the backing surface of the fabric remain substantially free of the latex clay froth. This particular fabric structure allows said fabric to remain soft, drapeable, air permeable, flexible, and with a good hand. This fabric structure also makes the fabric conducive to providing a bacterial barrier with hydrophobicity, which lends itself to use as a hospital operating room gown material. The above-mentioned properties also make this fabric adaptable for use in hospital drapes, upholstery or rain wear.

An object of this invention is to provide a surgical gown fabric that can be produced economically.

Another object of this invention is to provide a fabric substantially more comfortable than prior art.

Still another object of this invention is to provide a fabric that is more breathable, due to better air permeability of said fabric, while at the same time retaining a bacterial barrier.

An additional object of this invention is to provide a fabric with strength and flexibility while preserving drapeability and hand.

Still another object of this invention is to provide a fabric that is substantially free of lint.

Another object of this invention is to provide a fabric that is sterilizable.

A further object of this invention is to provide a fabric that may be heat sealed.

Other objects will be apparent from the remainder of the specifications and claims.

DESCRIPTION OF PREFERRED EMBODIMENT

The description that follows of the preferred embodiment of this invention is simple, but even though simplistic in its approach, it will revolutionize the hospital gown industry with its use.

Figure 1:
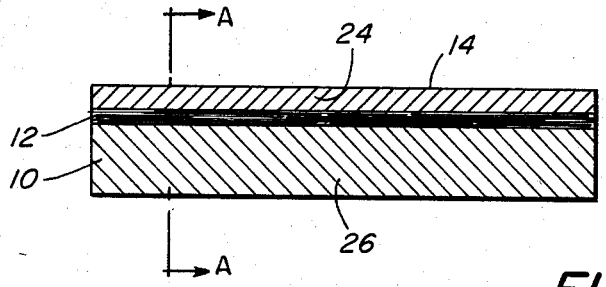
FIG. 1 illustrates a stratified single ply hydroentangled fabric with face surface fibers, froth and backing surface fibers.

FIG. 1 shows a fibrous web 10 which is typical of the preferred embodiment comprising hydroentangled textile length fibers and a latex microporous froth sizing 12 within the fiber structure. The illustrated fibrous web 10 should not be limited to the fabric thickness or depth of froth 12, as illustrated in FIG. 1, because a wide range of fabric thicknesses work equally as well.

Figure 2:
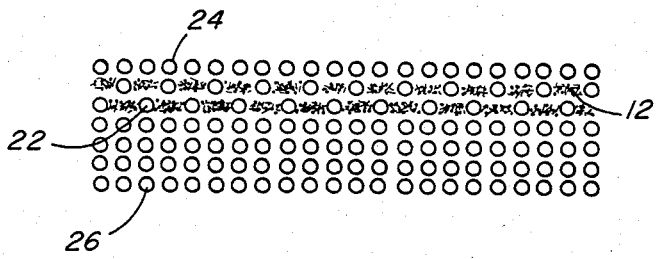
FIG. 2 shows a crossectional view of FIG. 1.
Figure 3:
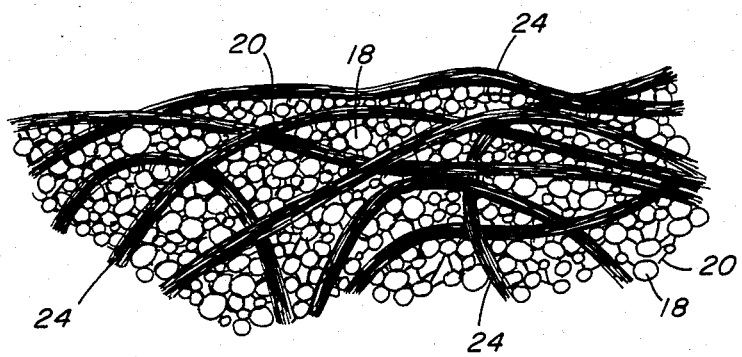
FIG. 3 is a plan view illustrating the face surface fibers, micropores and interconnecting links attached to said fibers.
Figure 4:
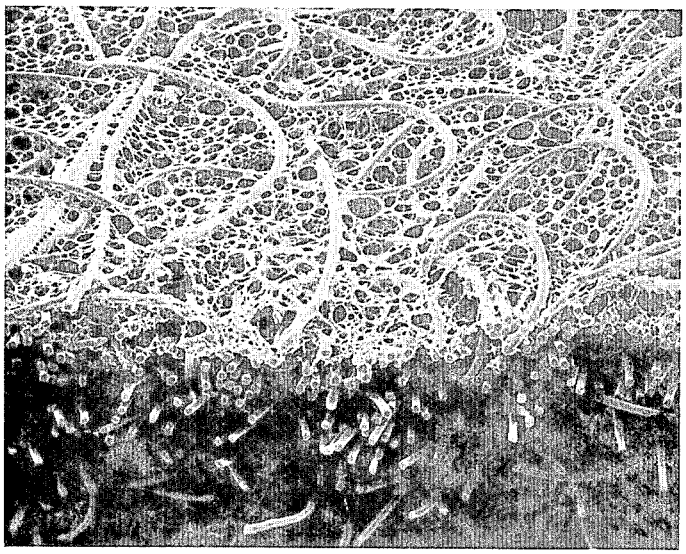
FIG. 4 is a photomicrograph of the present invention to illustrate the structure of the fabric more clearly.

In addition to hydroentangled fabrics, any woven or nonwoven material may also function as surgical gowns when microsized with a froth. The web 10 illustrated in FIG. 1 is approximately 14 mils in thickness, with a froth 12 located just below the face surface 14 of said fabric. The froth 12 is approximately one fiber diameter, in this case 15 microns, below the face surface 14 of the web 10 to a depth of at least 25% of the thickness of the fabric. One fiber diameter is defined as the cross-sectional thickness of an individual fiber being used in a fabric. It should be noted that the depth of the froth in any fabric that may be used will also be approximately 25% of the thickness of the fabric, starting at least one fiber diameter below the face surface. The reason for having the froth one fiber diameter below the face surface and not coating the fabric is to give the fabric the feel of a cloth. Plastic, rubber or other similar type coatings may make a fabric feel artificial. The froth 12, as shown in FIGS. 1 and 2, is applied to the web 10 by knife application, reverse roll application or other conventional procedures. During these procedures, froth 12 is deposited on the web 10 as it is passed through a trough of froth. It is then worked into the fabric as it comes between a knife and a roll. The web 10 is squeezed or matted down, thereby reducing the fabric thickness at the point of contact of the roll and knife as the froth 12 is being worked into the fabric. Once the web 10 has passed through this contact point where the knife and roll meet, the web 10, due to the memory of the fibers therein, returns to its original thickness. The web 10 returning to its original thickness, leaves the froth 12 approximately one fiber diameter beneath the face surface 14 of the web 10 at a depth of approximately 25% of the thickness of said fabric. The face surface of the treated fabric is thus scraped free of froth, so that the outermost fibers 24 have a substantially froth-free surface. However, as a practical matter the froth clings from the bottom of those fibers 24. This structure is most evident by reference to FIG. 4. Because the froth 12 remains beneath the face surface 14 of the web 10, the face surface fibers 24, as shown in FIGS. 2, 3, and 4, are straddled by interconnecting links 20 which are produced by the froth 12 and substantially hold the face surface fibers 24 in place. This straddling effect tends to further bond the face surface fibers 24 in place. The hydroentanglement of said fibers further enhances that bond, as described in this preferred embodiment. This spider-like web construction, as illustrated in FIGS. 3 and 4, is important because it substantially reduces lint that may be present in the fabric because the interconnecting links 20, as illustrated in FIGS. 3 and 4, touch the face surface 14 and inner core fibers 22 and, as previously mentioned, bond and secure them in place. The inner core fibers 22, as illustrated in FIGS. 2 and 4, are the fibers that are contained within the froth 12. To determine the amount of lint present in a fabric a test is conducted that consists of rubbing a number zero emery cloth against both surfaces of a fabric in a circular motion using at least 15 cycles. The number of cycles it takes to raise fibers is then recorded.

At this point, and as shown in the illustrated drawings, it should be noted that the froth 12 does not coat the web 10, but actually sizes the fabric. Sizing is defined as the application of a material to a fabric to fill voids in the fabric, and not to coat the fabric's surface.

Sizing the fabric, even though a single ply fabric, causes a stratification to take place within the fabric. FIGS. 1, 2 and 4 illustrate the stratified layers wherein the first or outer layer is the substantially uncoated, but interconnected face surface fibers 24 on the face surface 14; a second layer includes the froth layer 12 which is one fiber diameter beneath the face surface 14 of the web 10; and, finally, the backing surface layer including fibers 26 of the web 10 which remain substantially free from the froth and interconnected fibers. This unique stratification of a single ply material, allows the backing surface fibers 26 of the web 10 to remain virgin and substantially free of sizing. Because the fibers remain virgin, the softness, drapeability, hand and comfort to the wearer of the fabric, is preserved.

To check for the softness and comfort of a fabric, tests are available which will be discussed in more detail herein. The test for softness is conducted according to the Industrial Nonwoven Disposable Association Standard Test, IST 90.0-75(R77). The test is a Softness Handle-O-Meter test where forces are used to bend the fabric to determine the drape, hand and softness. In addition, to insure the fabric is comfortable, an internal test is performed, which is called a Cytotoxic Test. The Cytotoxic Test is actually a battery of tests which insures that the fibers and other components used within the fabric are non-irritating when placed against human skin. All fabrics tested herein passed this test.

The unique stratification of the present fabric essentially makes the web 10 a two-sided fabric. This gives an advantage of having a lined garment because the inner surface remains soft, while the outer surface has a protective facing. Another important factor is that the present invention, being a single ply fabric, is not subject to delamination. This is a problem that may exist in prior art and multiple ply fabrics, as mentioned earlier.

Referring back to the drawings, FIGS. 3 and 4, show the micropores 18 of the froth 12 situated between and adjacent to the face surface fibers 24 of the fabric. Micropores may be defined as open pores ranging in size from 10 to 100 microns. These pores are created by dispersing air, which creates air bubbles, in a latex liquid. The frothed liquid once deposited on a fabric is then heated to solidify the latex. The heat in curing the latex bursts the air bubbles thereby creating the micropores. These micropores 18 created from the froth 12 are important for two reasons. The first is that these micropores 18 allow the free movement of air through the fabric. In other words, these micropores 18 give substantial air permeability to the fabric. An air permeability test is conducted according to the Industrial Nonwoven Disposable Association Standard Test IST 70.1-70(R77) and Federal method 5452, referred to as the Frazier Test. The Frazier Test is to pass a certain volume of air through a certain area of fabric per unit time under a low pressure differential. Thus, the greater the volume of air passed through a fabric, the higher the air permeability. Air permeability is obviously necessary for comfort of the wearers of a surgical gown. Hospital personnel who wear surgical gowns in operating rooms need a material that allows body heat, which builds up while performing surgery or other tasks, to escape away from their bodies and permits any perspiration formed thereon to evaporate out through the fabric by the circulation of air. The second reason that micropores are important, in addition to providing excellent air permeability, is that the micropores provide a barrier on the outside surface of the fabric to liquid borne bacteria by stopping the flow of liquid, which may have bacteria in it, into and through the fabric. The phenomenon is believed to be accomplished by a capillary action force on the micropores which counteracts a driving force caused by a head of liquid. By preventing liquid from wicking through the gown, the wearer remains isolated from any bacteria or liquid present while performing surgery or other tasks.

To arrive at the maximum or optimum micropore size (i.e., pores which would hold back liquid in accordance with the required tests), a formula was derived. The derivation of the formula is as follows:

1. Liquid in channel, (Poiseuille's formula)

$$V_{max} = \frac{r^2}{4L_\xi} P \text{ total}$$

V=velocity of liquid
$\eta$=viscosity of liquid
r=radius of pore
L=depth of fabric/pore
P=pressure head 2. Capillary action, (La Place's formula)

$$\Delta P_{cap.} = \frac{2\gamma\cos\theta}{r}$$

$\gamma$=surface tension
P=pressure head
non-wetting angle* $\theta$=108°

*calculation of non-wetting angle taken from "Properties of Polymers" by D. W. Van Kreuelen 3. $\Delta P_{total} = \Delta P_{hydrostatic} + \Delta P$ cap.

The resulting formula to calculate micropore size is:

For V=0

$$-\Delta P_{\substack{hydro \\ static}} = \frac{2\gamma\cos\theta}{r}$$

V=velocity of liquid
P=pressure head
$\gamma$=surface tension
$\theta$=Non-wetting angle (108°)
r=radius of pore An example of how the formula is used in the calculation of microsize pores in the preferred embodiment, is:

Known Quantities:

$\theta$ = 108° $\Delta P$ hydro static = 4.5 inches of water = 11000 dynes per centimeter$^2$
cos $\theta$ = −.308 $r$ = radius of micropore in microns
$\gamma$ = 72.8 dynes per centimeter for water Formula For V=0

$$-\Delta P \text{ hydro static} = \frac{2\gamma\cos\theta}{r}$$

Substitution of known quantities:

$$-11000 \text{ dynes/cent.} = \frac{2\,(72.8 \text{ dynes/cent.})\,(-.308)}{r}$$

$$r = \frac{2\,(72.8 \text{ dynes/cent.})\,(-.308)}{-11000 \text{ dynes/cent.}^2} = 40 \text{ micron radius}$$

From the aforementioned formula, the micropore size of the preferred embodiment was calculated instead of guessing what size pores in the fabric would hold back liquid. With this information in hand, one then knows the theoretical size of cylindrical pores one needs to pass the Mason jar test and hydrostatic test, which are described in later paragraphs.

In addition to this microporous fabric keeping bacteria out, it is also essential in a surgical gown that the inside surface of the fabric must remain dry, so that any liquid that contacts the outside surface of the fabric does not wick through to the wearer. This wicking is undesirable, not only because it would make the wearer uncomfortable, but a liquid barrier formed by the froth in the fabric may be violated by allowing the liquid on the outside surface of the gown to wick through the fabric. Liquid on the outside surface of the gown usually contains bacteria, thus, the wearer would be susceptible to coming in contact with this bacteria if the liquid on the outside surface of the gown is permitted to wick through to the inner surface. To determine whether a fabric can hold back liquid, it is subjected to two tests—the Mason Jar Test and the Hydrostatic Head Test. The Mason Jar test is conducted according to the Industrial Nonwoven Disposable Association Standard Test, IST 80.7-70(R77), and the Hydrostatic Head Test is conducted according to the American Association of Textile Chemists and Colorists, AATCC-127-1974 and IST 80.0-70(R77). The Mason Jar Test is to determine the time it takes liquid to penetrate the fabric when said fabric is under a head of water of 4.5 inches, and the Hydrostatic Head Test is conducted to determine the amount of water pressure the fabric can withstand before water passes through said fabric. It is not easy for a fabric to pass this test, but the present fabric, as evident in Table 2, had no trouble in doing so.

Achieving micropores by using a froth has other benefits. One such benefit is the micropores enhance other features of the gown, such as flexibility of the fabric.

Although the froth may be considered a binding agent, its main purpose, in the present invention, is to create the micropores 18 mentioned earlier. While creating these micropores 18, the interconnecting links 20, as shown in FIGS. 3 and 4, which remain after the pores are created, straddle the surface fibers 14 of the web 10 and act similar to hinges. These interconnecting links acting as hinges maintain flexibility, strength, drapeability, and good hand in the web 10, which are characteristics important in a surgical gown and superior to what is available in the prior art.

The fabric needs flexibility in conjunction with strength, especially as a surgical gown, so it does not hinder freedom of movement of a wearer, nor tear in said movement during a surgical procedure or other tasks. If the fabric was not strong and tore during such a surgical procedure, the liquid and bacteria barrier would be lost, thus causing problems mentioned earlier in the discussion on liquid and bacterial barrier.

Two further tests for the fabric are described herein, one for flexibility, the other for strength. The flexibility test is performed in accordance with the Industrial Nonwoven Disposable Association Standard Test, IST30.0-70(R77), and the American Society of Testing Materials, ASTM D774-67. The strength tests are conducted in accordance with IST 110.0-70(R77), ASTM D1682.64 and ASTM D2261-71.

The test for flexibility is called the Mullen Burst Test, whereby a circular diaphragm is placed against the fabric to be tested. Pressure is then applied to the diaphragm until the fabric ruptures. The strength tests consist of a Tongue Test and a tensile strength test. The Tongue Test, tests the ability of the fabric not to tear. In this test, the fabric is cut into a rectangular piece 3 inches wide by 8 inches long. The rectangular piece of fabric is then slit in the center, half way down the fabric in the 3 inch width direction. The two ends of the slit piece are then attached to an Instron Tester (a tensile strength test machine made by Instron Corp. of Canton, MA) and subjected to a tearing force. This force is then recorded. The tensile strength test consists of taking a strip of fabric one inch wide by eight inches long and attaching said strip to an Instron tester. A force is exerted by the tester in the vertical direction to determine what force it takes to break or tear the fabric. When the fabric breaks, the force is then recorded.

The inherent flexibility of the base fabric is preserved, due to its structure and as already described; whereas the prior art detracts from flexibility by the use of excessive bonding, cementing, saturation, or impregnation of total prior art structure with binders thus creating a stiffer fabric—a characteristic of a hospital gown that is not tolerated by the wearers, because fabric stiffness tends to irritate the skin of the wearer.

Another important result that comes from this particular structure is that the fabric is quiet. Quietness in a hospital fabric is essential because operating room personnel, specifically doctors, need to have quiet in the operating room to improve their concentration while performing surgery.

Other advantages achieved herein over prior art include static decay and flame retardancy properties. A solution of 2% fluorocarbon may be applied directly to the fabric just after the fabric is formed and before applying the froth, and then a 2% fluorocarbon solution is also added as an integral part of the froth. The advantage here is in the application of the 2% fluorocarbon to the fabric in the froth because it is a novel way to obtain static decay, and when applied in this manner the fabric remains soft and not harsh as in prior art fabrics. The aforementioned application of fluorocarbon in the froth, gave an unexpected result, which was the obtaining of static decay qualities. Fluorocarbon is applied in prior art by saturation of the fabric, but static decay usually is not obtained by this method due to the low percentage of fluorocarbon used. Static decay as used herein in a fabric is the ability of the fabric to dissipate or remove a charge of electricity that builds up on a fabric. This charge of electricity is normally caused by rubbing certain materials against one another. This ability to discharge electricity is an essential element of a surgical gown because it is used in an operating room where oxygen and other explosive gases may be present.

To determine the static decay properties of a fabric, tests are conducted in accordance with the Industrial Nonwoven Disposable Association Standard Test, IST 40.0-79 and National Electrical Protection Association, NEPA 56A. Static electricity is induced in a fabric and then the electrical charge is dissipated while recording the amount of time it took to dissipate said charge.

One other advantage that was found unexpectedly which the present invention fabric has over prior art fabric is that fire retardant chemicals such as hydrates, halogen compounds and other compounds that absorb thermal energy, readily mixed with the latex clay sizing formulation. Prior art fabrics usually have fire retardant chemicals put on by saturating the fabric which causes the fabric to become harsher. As was the case with the fluorocarbon treatment, being able to mix fire retardants in the froth has many advantages and permits the present invention to retain the softness of the fabric.

To insure that a fabric is flame retardant, a flammability test is conducted in accordance with the Industrial Nonwoven Disposable Association Standard Test, IST 50.0-71(R77) and Federal Method 5908.1. The flammability test consists of applying an open flame to the fabric, which is inclined at a 45° angle. The amount of time it takes the flame to propagate 6 inches along the fabric is then determined.

Once again referring to the drawings, and as mentioned in prior paragraphs, the froth 12 is applied as a sizing. This is an important factor to bring out because prior art fabrics have coated surfaces, where the coating is applied to the surface of a fabric to form a continuous film over said surface. By coating a surface, additional and subsequent methods must be applied, especially in the making of a hospital gown, to acquire the characteristics mentioned previously, e.g., air permeability or hand, that are required and needed in a surgical gown. These additional methods may include a method such as crushing the fabric or the like to achieve similar characteristics as the present invention fabric.

The present invention is also economical to manufacture because it is a singly ply fabric, needing no process steps other than the forming of a single ply fabric and the sizing of said fabric. In addition to the above, because the froth in the fabric has a component that is substantially thermoplastic, namely the latex as referenced in Table 1, this fabric is heat sealable. With heat sealability, a hospital gown fabric may be completely fabricated and assembled by heat sealing all seams of a gown instead of using a sewing operation, thereby eliminating an entrance port for bacteria through each stitch hole.

It should be noted that up to 75% of clay may be added as an ingredient to the latex froth mixture. The addition of clay enhances the ability of the froth to be a more efficient liquid barrier. The clay, a low cost item, may also be used as a partial substitute for quantities of latex, which has a high cost. This then makes the fabric more economical to manufacture. It should also be noted that even though a particular type of clay is mentioned in Table I, any good quality clay free of foreign matter and glomerates may be used in its place.

Although not having the same test results as the preferred embodiment, examples 2 and 3 on Table 2 tested using ingredients in the froth referenced in Table 1, with the exception of varying the amounts of clay and Cymel, a trademark for a melamine resin made by American Cyanamid in Connecticut. Even though the clay and Cymel were varied substantially, no change in the required properties, as shown in the present invention, took place.

The preferred embodiment is a homogenous mass of hydroentangled fibers, microsized with a latex-clay froth therein, but any nonwoven or woven substrate, as mentioned previously, will respond substantially in the same manner as the preferred embodiment once microsized with a latex-clay formulation.

Test standards for the weight and thickness of fabrics to be acceptable as hospital gowns, which were not previously mentioned but are used in the examples which follow include: weight per unit area—IST 130.0-70(R77) and thickness IST 120.0-70(R77) and ASTM D1777-64.

To illustrate the superiority of the preferred embodiment over prior art fabrics, two tables giving test results of examples of the present invention and examples of the prior art are presented. To allow comparisons to be made between the present invention, prior art, and a standard hospital gown, the standard hospital gown test values, which are the accepted values in the hospital industry, are also given.

The tests and standards which have been described herein were used in the testing of the examples in Tables 2 and 3.

Table 2 contains and compares four (4) examples of the present invention:

EXAMPLE 1

A 40.8 gsy (grams per square yard) 100% polyester hydroentangled fabric, such as sold by DuPont Inc., located in Delaware, and identified as P004 was microsized in a continuous process by applying, via a knife-over-roll applicator, an ethyl-butyl acrylate-clay froth of the composition in Table 1.

The froth applied in Example 1 was first aerated by an Oakes Foamer, Model No. 4MT2A to a density of approximately 160 grams per liter by rotating the mixing heat at 1125 revolutions per minute and pumping at a setting of 180 (200 grams per minute). The back pressure at the foamer was 55 pounds per square inch of gage. The froth was fed batch-wise in 5–10 minute intervals to the knife-over-roll applicator. The gap between the knife and roll was set at 11 mils. The fabric weighed 40.8 gsy (grams per square yard) before microsizing and 53.5 gsy afterward.

The process line speed was 10 feet per minute and the microsized web was dried in an air circulating oven with three zones set at 210° F., 225° F., and 250° F., respectively. Photomicrographs that were taken revealed: the sizing penetration into the fabric was 60–80 microns of the total 300 micron fabric thickness; the surface fibers were not coated; and that the average pore size was between 20 and 40 microns, with a few pores at 80 microns. FIG. 4 is illustrative of the above description.

Example 1 had not been exposed to enough heat during the initial test to pass the Mason jar test for hydrophobicity, so the material was passed through the oven again at 10 feet per minute at 235° F., 260° F., and 310° F., for the three zones, respectively. This time example 1 passed all the required tests, as is evidenced in Table 2.

It has since been illustrated in other examples, where the same parameters were used as in the first example except for the oven temperatures, that by adjusting the temperatures to 250° F., 275° F., and 320° F. for the three zones, respectively, it was found that the other preferred embodiment examples passed the Mason jar test in addition to passing all the other necessary tests.

EXAMPLE 2

A 100% polyester fiber hydroentangled fabric weighing 54 $gyd^2$ (such as sold by DuPont as Sontara 8103) was microsized in the laboratory on a flat bed table. The fabric was first treated with a 2% FC824 fluorocarbon solution to a wet pickup of about 400%, i.e., wetted fabric weighs four times the orignal dry fabric. The froth used was the same as noted in Table 1, with the exceptions of no clay and only one-half the amount of Cymel resin. The density of the froth, which was made in a Kitchen-Aid mixer, was about 160 g/L (gram per liter).

The resulting product weighed 70 gsy; i.e. the add-on of microsize froth was 16 gsy. The fabric easily passed the Mason Jar test with a reading of 120 minutes. Its air permeability was 107 cu.ft./sq.ft./min. (cubic feet per square foot per minute) The hydrostatic head was 8.5" by the test method listed in Table 2. The static decay test was also passed at 0.15 seconds M.D. (machine direction).

EXAMPLE 3

A sample, as described in Example 2, was prepared, wherein the froth mix contained the proportions of Table 1, except that the amount of clay in the froth was 2.5 times that listed. The froth was applied to the fluorocarbon treated 54 gsy DuPont's Sontara 8103 fabric. The resulting fabric, after being heated at 162° C. for 8 minutes in an air circulatory oven, had a 120+ minutes Mason Jar test value and an air permeability of 78 cu.ft./sq.ft./minute. The hydrostatic head was satisfactory for a laboratory sample at 7½ inches. The fabric passes the MD static decay test at 0.3 sec. outer face and 0.2 sec. inner face.

EXAMPLE 4

A deviation from the other three examples was used to show that other fibers could also work. The previously mentioned examples had used 100% polyester fiber. The same froth used with Example 1 was applied to a substrate consisting of a hydroentangled fabric of 50% rayon and 50% polyester fiber. The fabric weighing 42 gsy was pretreated with the 2% fluorocarbon solution. Then, 21 gms. (grams) of froth was applied by the same procedure as outlined in Example 2.

The Mason jar test was run on this microsized heated fabric weighing 63 gsy. The hydrostatic head was 9.1 inches and its air permeability 120 cuft/sqft/min. The static decay value was satisfactory for this type fabric at 0.6 sec. M.D.

It should be noted, not all tests for the properties on Table 2 were run on Examples 2, 3, and 4. The essential tests, e.g., Mason jar, air permeability, hydrostatic head and static decay, were the only tests run because they are the most important. It is assumed, based on prior experience where typical fabric and froth are used, Examples 2, 3, and 4 would pass the other tests, which are not as critical.

Table 3 contains five (5) examples of fabric presently being produced by other companies and which may be used for the same purpose as the present invention, namely hospital surgical gown fabric.

Example A is a fabric with a tradename of Sontara produced by DuPont of Wilmington, Del., which is comprised of 60% paper fiber and 40% polyester hydroentangled fiber.

Example B is another fabric with a tradename Remey produced by DuPont of Wilmington, Del., comprising 100% polyethelene (spunbound) fibers.

Example C is a fabric with a tradename Assure II, produced by Dexter Company, located in Windsor Locks, Conn., comprising wet laid paper fibers and a latex binder.

Example D is a fabric with a tradename Spungard, produced by Kimberly-Clark, located in Rosewell, Ga., comprising plastic, nonwoven and meltblown fibers.

Example E is a fabric with a tradename Signature, produced by Procter and Gamble, located in Memphis, Tenn., comprising a combination of paper fiber as the first ply, spunbound as the middle ply and paper fiber as the bottom ply of the fabric.

The second chart is made up of typical examples of fabrics used as surgical gowns, so, when a comparison of Table 3 is made to Table 2, it becomes evident, when all the test results are considered together, the present invention is far superior to the prior art.

The present invention is not intended to be limited to the aforementioned examples in Table 2, but only as to the attached claims.

TABLE I

| FROTH MIX | | | | |
|---|---|---|---|---|
| | | AMOUNT | | |
| INGREDIENT | % SOLIDS | WET | DRY | *PP/100 |
| Hi-white clay<br>J. M. Huber Corp. - Maryland | 100 | | 28.5 lbs. | |
| Water | 100 | 15 lbs. | | 63 |
| RU Silicate, sodium | 50 | 105 grams | 52.5 grams | |
| 68-545-8<br>Latex<br>Reichhold - Delaware | 50 | 90 lbs. | 45 lbs. | 100 |
| Cymel 303 (Melamine Resin)<br>Cyanamid - Connecticut | 100 | 1000 grams | | 5 |
| Polystep F-9<br>69-459-8<br>Reichhold - Delaware | 30 | 675 grams | | 1 |
| Ammonium stearate,<br>American Chemical - Rhode Island | 30 | 10.5 lbs. | | 7 |
| Alcogum L-15<br>Alco Chemical - Tennessee | | 99 grams | | .5 |
| Graphtol Blue,<br>682502-020<br>Sandoz - New Jersey | | 360 milliliter | | |
| Graphtol Yellow,<br>4534-020<br>Sandoz - New Jersey | | 75 milliliter | | |
| Black Shield #10795<br>CDI Dispersions - New Jersey | | 90 milliliter | | |
| Fluorocarbon FC824<br>3M - Minnesota | 40 | 1200 grams | 480 grams | 2.4 |

*Parts Per 100

TABLE 2

| PROPERTIES OF MICROSIZED FABRIC | | | | | |
|---|---|---|---|---|---|
| PROPERTY | HOSPITAL ACCEPTABLE VALUES | EXAMPLE I | EXAMPLE II | EXAMPLE III | EXAMPLE IV |
| Weight per area, gsy | 50–60 | 53.5 | 70 | 53.5 | 63 |
| Tensile strength, lb | | | | | |
| MD (Machine Direction) | 15* | 40.4 | — | — | — |
| CD (Cross Direction) | 12* | 13.4 | — | — | — |
| Elongation at break, % | | | | | |
| MD | — | 25.6 | — | — | — |
| CD | — | 183.3 | — | — | — |
| Mullen Burst, psi | 30* | 57.8 | — | — | — |
| Tongue Tear, lbs | | | | | |
| MD peak | — | 2.0 | — | — | — |

TABLE 2-continued

| PROPERTY | HOSPITAL ACCEPTABLE VALUES | EXAMPLE I | EXAMPLE II | EXAMPLE III | EXAMPLE IV |
|---|---|---|---|---|---|
| | PROPERTIES OF MICROSIZED FABRIC | | | | |
| Average | 1.5* | 1.5 | — | — | — |
| CD | 1.5* | no tear | — | — | — |
| Energy to tear, inch-lb | — | 8.9 | — | — | — |
| Handle-o-meter, gm force | | | | | |
| MD | — | 85.7 | — | — | — |
| CD | — | 8.1 | — | — | — |
| Overall | 50** | 47 | — | — | — |
| Air Permeability, Frazier | | | | | |
| cuft/sqft/min | 50* | 103.5 | 107 | 78 | 120 |
| Hydrostatic Head, inches of water | 9* | 9.5 | 8.5 | 7.5 | 9.1 |
| Mason Jar Test, min. (5 samples required) | 60* | 60+ 120+ | 120 | 120 | 60+ |
| Abrasion, cycles to 1st pill | | | | | |
| Outer Face | 15* | 22 | — | — | — |
| Inner Face | 15* | 26.2 | — | — | — |
| Flammability, sec. (5 samples required) | 3.0* | All Passed | All Passed | All Passed | All Passed |
| Static Decay, sec. | | | | | |
| MD, both sides; + and − | 0.50** | .06 | 0.15 | 0.3 | 0.6 |
| CD, both sides; + and − | 0.50** | .46 | — | 0.2 | — |
| Cytotoxic Test (Living tissue test) | Passed | passed | — | — | — |

*minimum value
**maximum value

TABLE 3

| PROPERTY | HOSPITAL ACCEPTABLE VALUES | EXAMPLE A | EXAMPLE B | EXAMPLE C | EXAMPLE D | EXAMPLE E |
|---|---|---|---|---|---|---|
| | PROPERTIES OF FABRIC | | | | | |
| Weight per area, gsy | 50–60 | 64.0 | 40.0 | 55.0 | 42.9 | 55.5 |
| Mullen Burst, psi | 30+ | 47.0 | 50.0 | 24.3 | 21.7 | 20.6 |
| Tongue Tear, lbs | | | | | | |
| MD peak | | | | | | |
| Average | 1.5+ | 1.5 | 1.5 | 0.7 | 1.0 | — |
| CD | 1.5+ | 3.0 | 1.5 | no tear | 1.0 | — |
| Energy to tear, inch-lb | | | | | | |
| Handle-o-meter, gm force | | | | | | |
| MD | — | 64 | 17.0 | 34 | 20.9 | 29.0 |
| CD | — | 13 | 21 | 39 | 32.6 | 16.0 |
| Overall | 50++ | 39 | 19 | 37 | 27 | 22.7 |
| Air Permeability, Frazier | | | | | | |
| cuft/sqft/min | 50+ | 82 | * | 49.1 | 17.1 | — |
| Hydrostatic Head, inches of water | 9+ | 9 | 25 | 10.1 | 20.2 | 9.05 |
| Mason Jar Test, min. (5 samples required) | 60+ | 60 | 60+ | 90 | 60 | 60 2 passed |
| Flammability, sec. (5 samples required) | 3.0+ | 3.5 | 3.5 | 3.5 | DNI** | — |
| Static Decay, sec. | 0.5++ | 0.5 | 0.5 | 0.5 | 0.03 | — |
| Cytotoxic Test (Living Tissue Test) | Passed | — | — | — | — | — |

*low porosity - will not test
**did not ignite, but melted
+minimum value
++maximum value

What is claimed is:

1. A porous, breathable, liquid and bacterial barrier material comprising: a single ply fibrous web having a substantially froth-free face surface, a sized inner core and a substantially froth-free backing surface and, said sized inner core includes a froth size within said web disposed beneath said face surface; said backing surface being substantially free of said froth size, said froth size further including a plurality of micropores disposed throughout.

2. The barrier material of claim 1 wherein said fibrous web is a woven material.

3. The barrier material of claim 1 wherein said fibrous web is a nonwoven material.

4. The barrier material of claim 1 wherein said fibrous web is a hydroentangled nonwoven fabric.

5. The barrier material of claim 1 wherein said micropores range in size from about 10 microns to 100 microns in diameter.

6. The barrier material of claim 1 wherein said froth sizing is an aerated latex froth size.

7. The barrier material of claim 6 wherein said froth sizing is an aerated latex-clay froth size.

8. The barrier material of claim 7 wherein said latex-clay formulation comprises 25–100% acrylic latex and 0–75% clay.

9. The barrier material of claim 7 wherein said froth sizing further includes a 2% fluorocarbon component therein.

10. The barrier material of claim 7 wherein thermal absorbing compounds are included within the microporous froth sizing.

11. The barrier material of claim 7 wherein said latex is substantially thermoplastic.

12. The barrier material of claim 7 wherein the density of said microporous froth sizing is 100–300 grams per liter.

13. The barrier material of claim 7 wherein said micropores range in size from about 10 microns to 100 microns in diameter.

14. A porous, breathable, liquid and bacterial barrier material comprising:

a single ply, hydroentangled nonwoven web having a substantially froth-free face surface, a sized inner core and a substantially froth-free backing surface and, said sized inner core includes a latex-clay froth size within said web disposed beneath said surface; said backing surface being substantially free of said froth size, said froth size further including a plurality of micropores ranging in size from about 10 microns to 100 microns in diameter disposed throughout.

* * * * *